US005239775A

United States Patent [19]

Landau

[11] Patent Number: 5,239,775

[45] Date of Patent: Aug. 31, 1993

[54] ELASTIC WRAP FOR PLANT MATERIALS AND METHOD FOR COVERING SUCH MATERIALS

[76] Inventor: Simcha Landau, 71 Garwood Rd., Fair Lawn, N.J. 07410

[21] Appl. No.: 891,835

[22] Filed: Jun. 1, 1992

[51] Int. Cl.[5] ..... A01G 9/02

[52] U.S. Cl. ..... 47/72; 206/423

[58] Field of Search ..... 47/72, 28.1, 71; 206/423; 229/87.03

[56] References Cited

U.S. PATENT DOCUMENTS

| | | | |
|---|---|---|---|
| 1,994,962 | 3/1935 | Rushfeldt | 206/423 |
| 2,035,384 | 3/1936 | Hinchliff | 47/72 |
| 3,094,810 | 6/1963 | Kalpin | 47/28.1 |
| 3,556,389 | 1/1971 | Gregoire | 47/72 |
| 4,137,668 | 2/1979 | Kojo | 47/71 |
| 4,300,312 | 11/1981 | Weder et al. | 47/72 |
| 4,333,267 | 6/1982 | Witte | 47/72 |
| 4,413,725 | 11/1983 | Bruno et al. | 47/72 |
| 4,508,223 | 4/1985 | Catrambone | 47/72 |
| 5,129,182 | 7/1992 | Weder | 47/72 |

FOREIGN PATENT DOCUMENTS

| | | | |
|---|---|---|---|
| 2567068 | 1/1986 | France | 47/72 |
| 2619698 | 3/1989 | France | 47/72 |
| 0634458 | 1/1938 | Switzerland | 47/28 R |
| 2176682 | 1/1987 | United Kingdom | 47/28 R |

*Primary Examiner*—Ramon S. Britts
*Assistant Examiner*—Joanne C. Downs
*Attorney, Agent, or Firm*—W. Patrick Quast

[57] ABSTRACT

An elastic wrap is described for covering plant materials of virtually any size and shape, having an elastic opening within the wrapping material. Combining this elastic wrap with a secondary wrap permits the simultaneous utilization of two wrapping materials at the same time. In addition the secondary wrap forms a pot cover when the elastic wrap and secondary wrap are used to cover potted plants.

8 Claims, 5 Drawing Sheets

ELASTIC WRAP FOR PLANT MATERIALS AND METHOD FOR COVERING SUCH MATERIALS

BACKGROUND OF THE INVENTION

This invention relates to covering plants, floral bouquets, fruit baskets and the like for purposes of display and transportation, and in particular an elastic covering for a variety of sizes of such displays.

Florists utilize many specific items to attractively display and assist in convenient transport for hanging baskets, bouquets, fruit baskets, and floral arrangements. In addition completely flexible wrappings such as decorated paper and plastic sheets are employed to cover the limitless number of sizes and shapes retail florists must constantly process. Versatile, attractive, and functional wrapping materials are clearly desirable for dealing with these myriad floral packaging problems.

The instant invention addresses these problems by providing an elastic wrap to fit virtually any object encountered in day to day floral retailing. Further, the elastic wrap provides a convenient means for simultaneously supplying a pot cover for planters and similar items.

SUMMARY OF THE INVENTION

A primary object of the invention is to provide a wrap for plant materials of virtually any size and shape.

A further object of the invention is to simultaneously provide a permanent and disposable plant wrap.

Still another object is to simultaneously provide two different types of plant wrap.

An additional object is to add convenience for hanging a plant display.

Another object is to assist in providing a suitable environment for plant materials.

A further object is to provide a convenient means for tansporting covered plant materials.

These and other objects are obtained with this elastic wrap and method for covering plant materials.

In the instant invention a sheet of material is taken and an opening is made within the borders of the material. This opening is preferably located near the center of the material, and said material can be almost any shape, as, for example, round, rectangular, square, triangular, etc. The material itself can be fabricated in virtually a limitless number of ways such as out of aluminum foil, clear plastic, metalized plastic, paper, and so on. It is essential that at least the edge of the opening be elastic. This can be accomplished by attaching an elastic trim to this edge, or the material itself can be elastic as in the case of a sheet of an elastomeric urethane. In the case of an elastic trim, the trim can be made out of a natural latex, or a synthetic elastomer. The trim can be sewn onto the edge of the opening within the material, or attached in a number of other ways such as heat sealing, etc.

For example, a 0.001" thick square sheet of clear cellophane plastic measuring $2\frac{1}{4}' \times 2\frac{1}{4}'$ can have a 4" circular hole cut at its center. A cloth covered elastic trim can then be sewn onto the edge of this opening. Virtually any floral display can be attractively covered with this elastic wrap. This opening at the center of the wrap can be stretched to accommodate a variety of dimensions of the stem diameters of floral bouquets, securely engaging the stem area at a pre-selected height, with the remainder of the clear cellophane wrap now capable of being conveniently folded over the flower portion of the bouquet, forming a temporary covering with the cellophane wrap secured to itself in a conventional manner by means of scotch tape or staples.

Similarly this same elastic cellophane wrap can conveniently cover plant materials held in baskets or pots, as, for example, hanging baskets and planters. In the case of a hanging basket loop holes can be provided near the external corners of the cellophane wrap as an added convenience. The elastic opening in the wrap then fibs over the base of the basket, and is then permitted to grasp the sides of the basket at a pre-determined height from the base of the basket. The remainder of the wrap then is placed over the plant display, with the loop holes at the external corners of the wrap now being pulled over the hook portion of the hanging basket. This effectively eliminates the need for scotch tape or staples that would usually be required to complete a cover of this type.

This same elastic wrap described above can be further modified to have a number of air holes within it so that if the wrap Were left in place for a prolonged period of time a normal air environment would surround the plant.

In the case of planters within pots, again this same elastic wrap can be secured to pots of widely differing shapes and diameters to provide an attractive cover for display and transport. The loop holes within the corners of the wrap described for use with the hook on a hanging basket provide convenient "finger" holes for transport.

Placing a second sheet of material over the opening in the elastic wrap provides significant additional conveniences for the florist. While the elastic wrap described above is a clear plastic sheet, it can, of course, be colored or decorated in any suitable manner. However, having the elastic wrap substantially clear as it covers the plant display would normally be the preferred embodiment. This second sheet of material placed over the opening in the elastic wrap now gives the florist an option to have two different wraps for the plant material at the same time. For example, this second sheet of material (which, of course, can be fabricated in virtually any size and out of any suitable material) can be a colored aluminum foil square measuring $18'' \times 18''$. A potted planter can now be placed at the center of this aluminum foil sheet. The opening within the elastic wrap beneath the aluminum foil is now stretched to accommodate the outer diameter of the planter pot, and is pulled upward to a pre-determined height from the base of the pot, where the elastic wrap is permitted to grasp the sides of the pot. This operation necessarily causes the aluminum foil to take the shape of the planter pot, effectively forming an attractive pot cover. By modifying the elastic wrap to have a weakened tear line or perforated tear line just outside of the elastic opening the elastic wrap can be torn away and discarded when no longer necessary, leaving behind the aluminum foil as a permanent pot cover, secured to the original planter pot by the remaining portion of the elastic opening trim of the elastic wrap. This method is also useful for bouquets and floral arrangements when it is desirable to have complete coverage of the plant material, as, for example, with an attractive decorated base and a clear covering for the floral display.

DETAILED DESCRIPTION OF THE PREFERRED EMBODIMENTS

Figure 1:
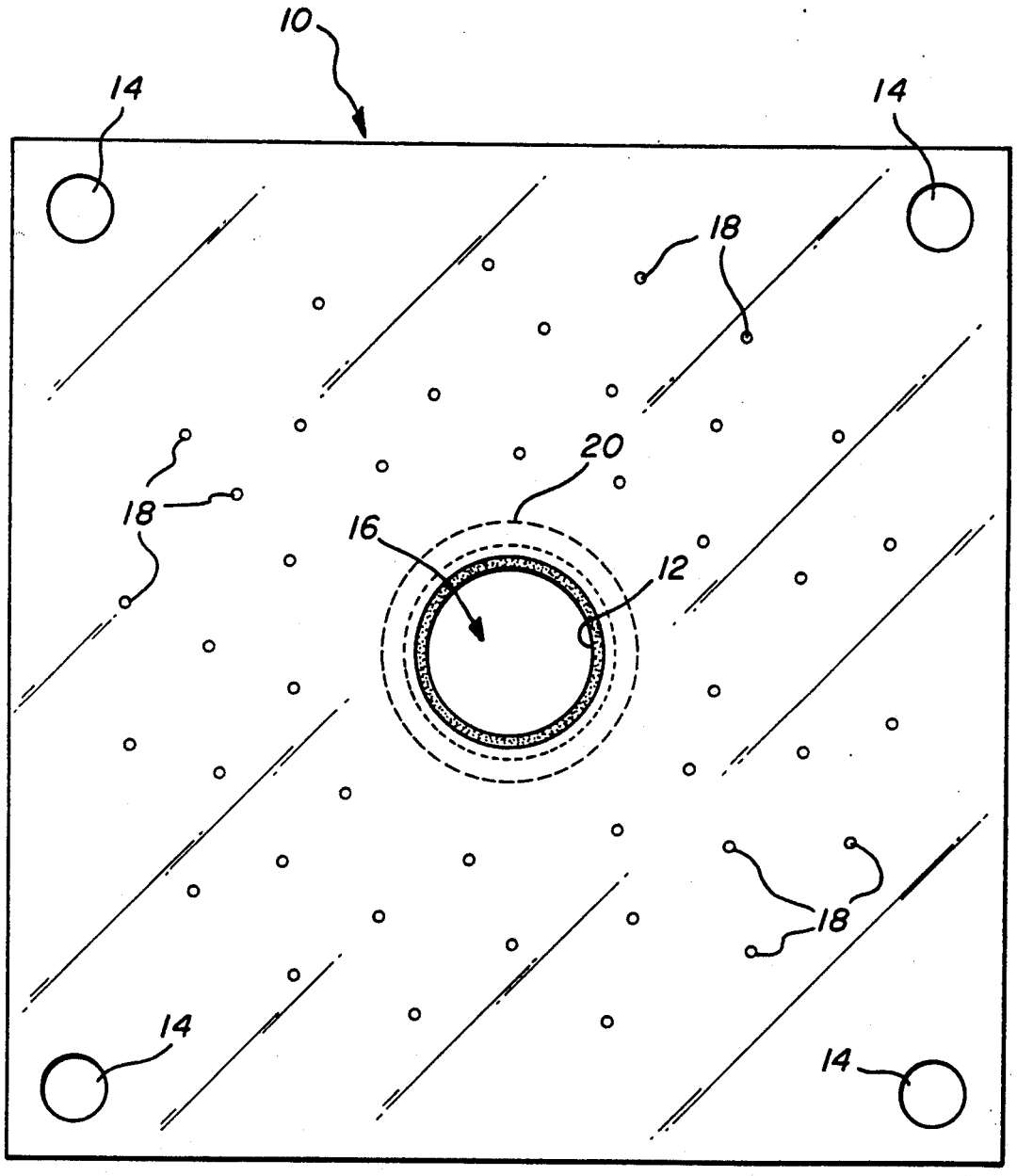
FIG. 1 is a perspective view of the elastic wrap of the invention.

Referring now to FIG. 1 the elastic wrap 10 of the invention is shown. In a preferred embodiment elastic wrap 10 can be made out of a thin (e.g. 0.001" thick), rectangular sheet of clear cellophane plastic measuring, for example, 2¼'×2¼'. A 4" diameter opening 16 is cut out near the center of the cellophane sheet, and a cloth covered elastic trim 12 is sewn onto the edge of opening 16, with a sufficient excess portion of the cellophane sheet incorporated within elastic trim 12 to permit wide stretching of the elastic trim as required. Many other methods can be employed to attach an elastic trim such as heat sealing an elastic trim to the opening edge, etc. The elastic trim 12 can make use of natural latex or synthetic elastomers for its elastic qualities, or, alternatively, the elastic wrap itself can be fabricated out of an elastomer such as elastomeric urethane. Loop holes 14 are cut into each corner of elastic wrap 10 to facilitate transporting baskets, pots and the like, and to add convenience when covering hanging baskets. Air holes 18 can also be incorporated into elastic wrap 10 so that a normal air environment surrounding the plant material is maintained if the wrap is left in place for a prolonged period of time. Tear line 20 can also be incorporated into elastic wrap 10 by having a weakened portion or perforated line (as is well known to the art) immediately adjacent the elastic trim 12.

Figure 3:
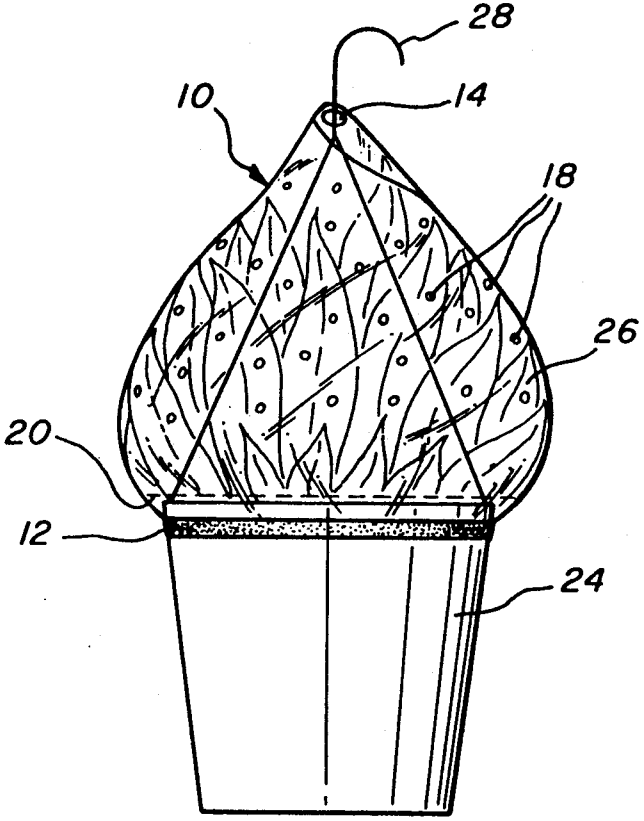
FIG. 3 is a side elevational view of a hanging basket with the elastic wrap of the invention secured to the sides of the basket, and covering the floral display.

FIG. 3 illustrates utilizing elastic wrap 10 as a cover for a floral display 26 or other plant materials within hanging basket 24. Wrap opening 16 is stretched by means of elastic trim 12 to encompass the exterior of hanging basket 24, with the elastic trim 12 allowed to grasp the top portion of basket 12. The remaining portion of elastic wrap 10 is then folded over floral display 26. The four corners of wrap 10 are conveniently secured by passing hook 28 through each of the four loop holes 14.

Figure 2:
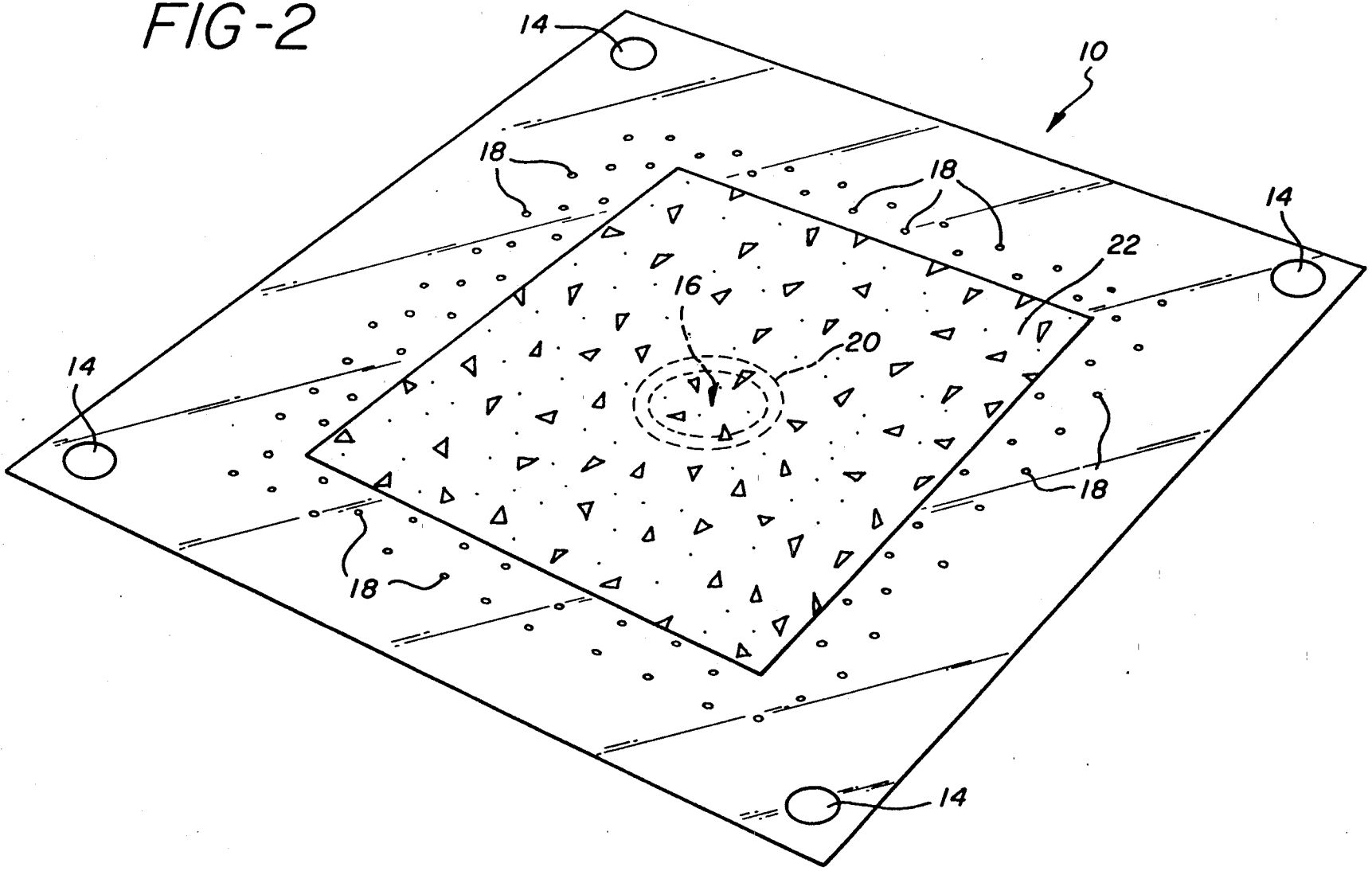
FIG. 2 is a perspective view of the elastic wrap of the invention with a decorative second sheet of material in place covering the opening within the elastic wrap.
Figure 6:
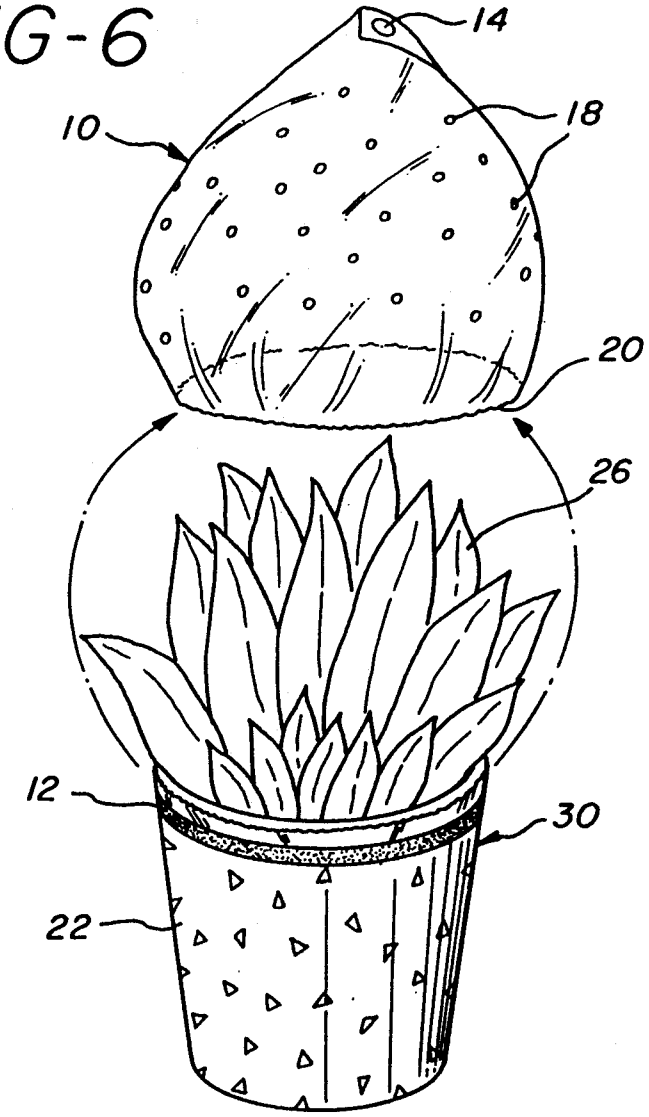
FIG. 6 illustrates the second wrap secured to a planter pot with the major portion of the elastic wrap removed.
Figure 4:
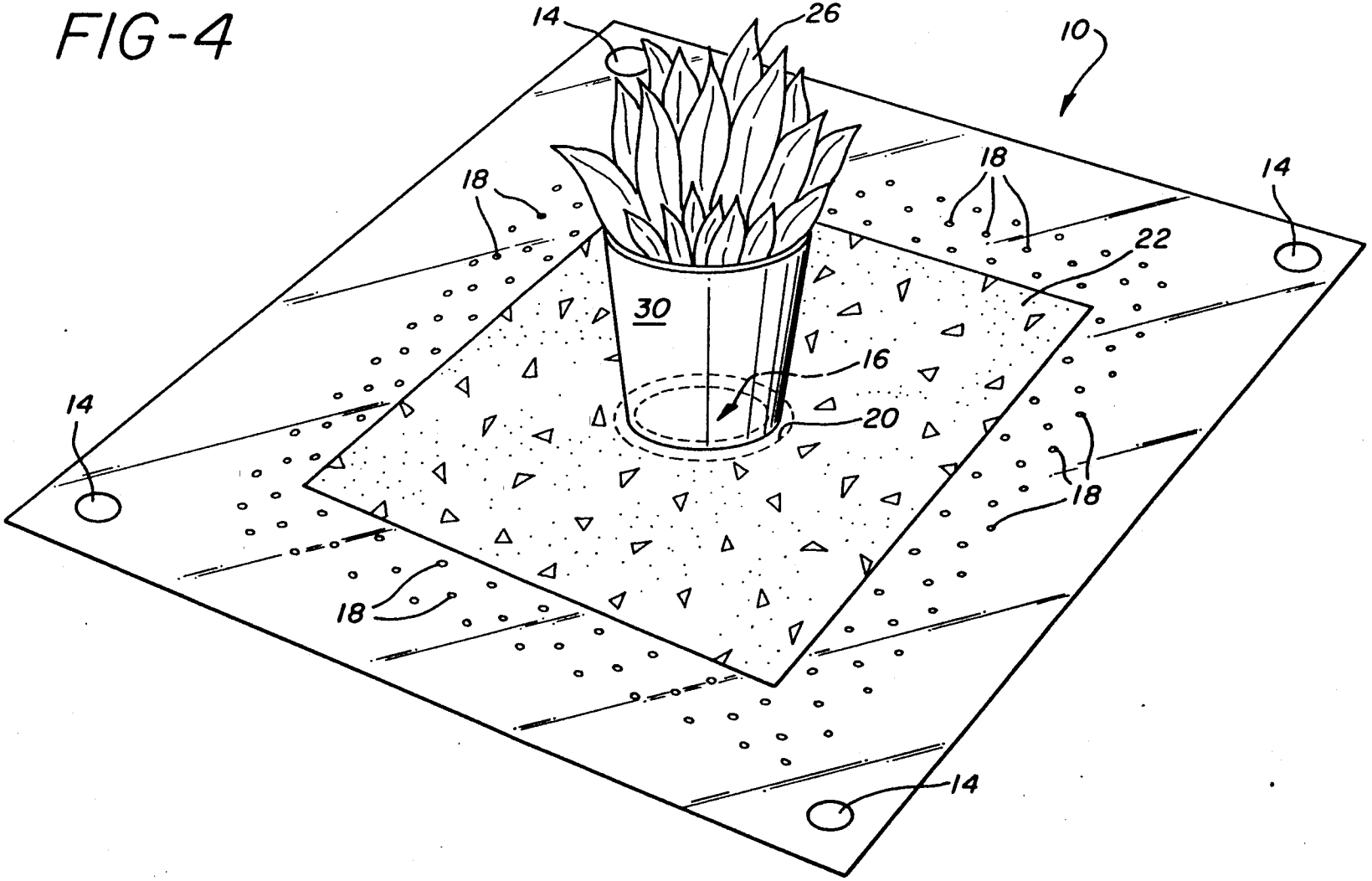
FIG. 4 is a view of the invention similar to FIG. 2, with a planter and pot shown in place, about to be covered.
Figure 5:
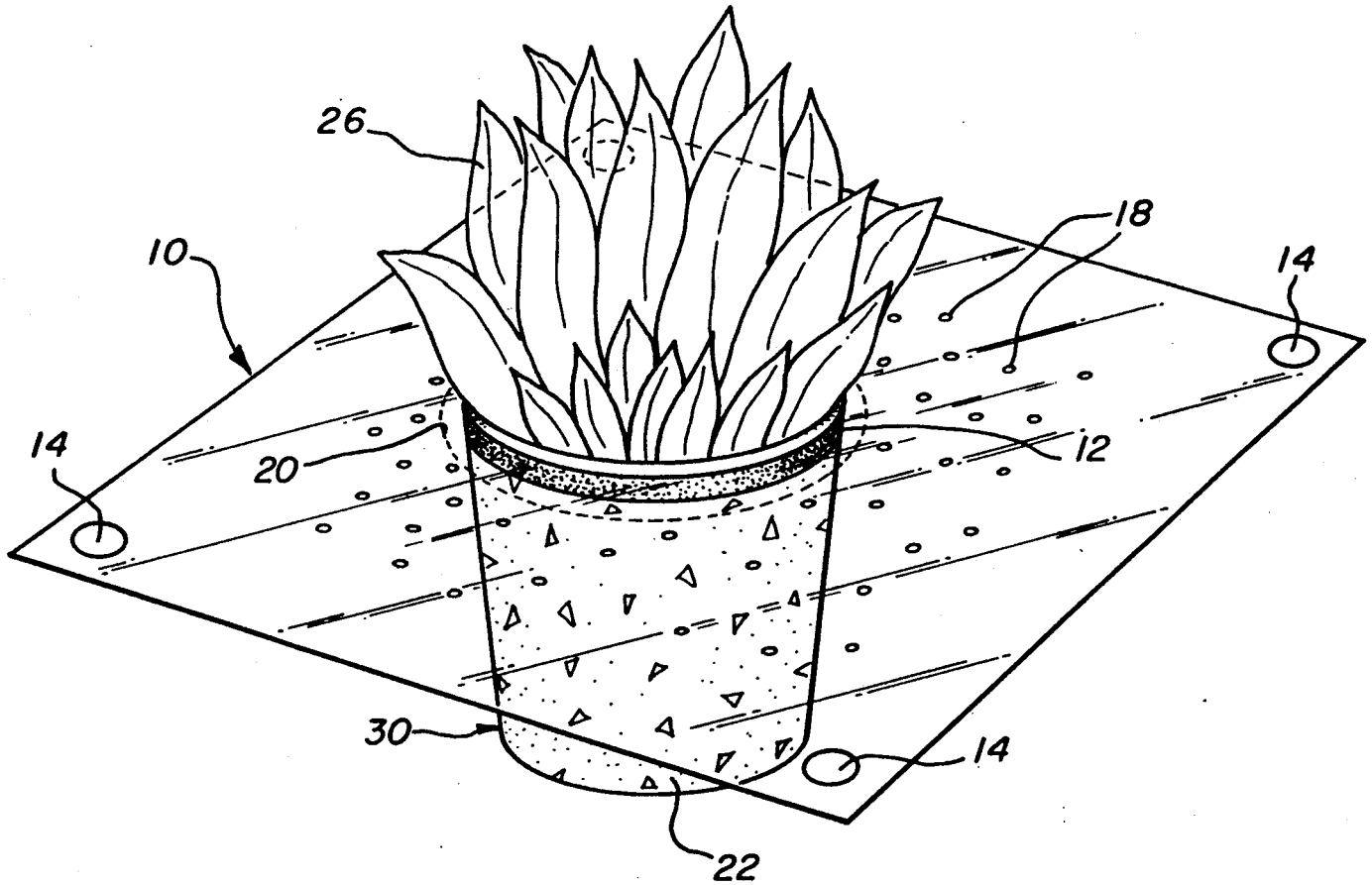
FIG. 5 is a perspective view of the elastic wrap of the invention shown securing the second wrap around a planter pot prior to folding the elastic wrap over the floral display.

FIGS. 2 and 4 illustrate a preferred embodiment for adding a second sheet of material to elastic wrap 10. In FIG. 2 a decorative second sheet 22 is shown lying on the flat upper surface of wrap 10, completely covering opening 16. FIGS. 2, 4, and 5 illustrate the utility of this second sheet for providing a florist with the option of employing two different covering materials simultaneously. For example, second sheet 22 can measure 18"×18" and be fabricated in a decorative aluminum foil. Potted plant 30 (FIG. 4) together with its floral display 26 is placed base down in the center of second sheet 22. Elastic trim 12 (FIG. 5) then is stretched to enable opening 16 to fit over the base of potted plant 30, and trim 12 is moved in an upwardly direction until trim 12 grasps the top portion of potted plant 30. While placing trim 12 and wrap 10 in this position, second sheet 22 is also conveniently folded around potted plant 30, and is permanently secured to the outer surface of potted plant 30 by means of elastic trim 12, in effect forming a pot cover for potted plant 30. The remaining portion of elastic wrap 10 can now be folded over floral display 26. When elastic wrap 10 is no longer required (FIG. 6) it can be simply torn away at tear line 20, leaving behind second sheet 22 secured by elastic trim 12 to potted plant 30 to form an attractive, permanent pot cover for potted plant 30. Similarly this same method employing both elastic wrap 10 and second sheet 22 can be used for bouquets and other floral arrangements wherein it is desirable to have a decorative covering for stem material, and a clear cover for the floral arrangements.

All of the above mentioned dimensions and materials of fabrication can, of course, be altered in a variety of ways to suit various plant material packaging requirements. As can be seen from the foregoing, elastic wrap 10 together with the second sheet 22 provides important and attractive plant covering conveniences to the florist.

While the present application has been directed specifically to floral packaging of "plant materials", the elastic wrap of the present invention can also be used in other applications where the purposes achieved by the present invention are readily desired. So, for example, in the gift industry, and by way of illustration only, the wrapping of an Easter basket, utilization of the elastic wrap of the present invention is desired and readily apparent. So, the term "plant materials" as used in the following claims should not be limited to the floral industry, necessarily, where other, obvious applications are readily apparent.

Since many changes could be made in the above constructions and many apparently widely different embodiments of this invention could be made without departing from the scope thereof, it is intended that all matter contained in the above description or shown in the accompanying drawings shall be interpreted as illustrative, and is to be limited only by the following claims.

What is claimed is:

1. An elastic wrap for the display and transport of plant materials, said plant materials including a base portion and a top portion, comprising:

(a) a cover material including a peripheral border and having an opening defined by an edge portion, within the peripheral border of said cover material, and, (b) an expandable elastic trim member fixedly secured to said edge portion defining said opening so that said opening can be enlarged continuously from an initial area to a second, larger, opening area to fit over the base portion of said plant materials, said plant materials having various sizes and shapes, said expandable elastic trim member capable of being moved upward along said base portion of said plant materials and elastomerically secured to said base portion of said plant materials at a predetermined height up along said base portion of said plant materials, the cover material being capable of being folded in a generally upward direction from said base portion of said plant materials, and over the top portion of said plant materials to wrap the top portion of said plant materials within said cover material.

2. The elastic wrap according to claim 1, further comprising air holes within said wrap to provide a normal atmosphere within said wrap when said wrap remains in contact with said plant materials for prolonged periods of time.

3. The elastic wrap according to claim 1 further comprising loop holes near the peripheral border of said wrap.

4. The elastic wrap according to claim 1 wherein said elastic wrap is fabricated in a clear material.

5. The elastic wrap according to claim 1 further comprising a second sheet of material, said second sheet of material being of sufficient dimensions so as to cover a substantially larger area than the initial area within said opening within said elastic wrap, said second sheet of material cooperating with said elastic wrap to form a plant material cover when said second sheet of material is placed over the opening within said elastic wrap, so that when the combination of said second sheet and said elastic wrap is placed over the base portion of said plant materials at least an upward portion of the base portion of said plant materials is covered by said second sheet, said second sheet being secured to said base portion of said plant materials by said elastic trim member, the remainder of said plant materials above said elastic trim member being covered by said elastic wrap.

6. The elastic wrap according to claim 5 further comprising a tear line circumscribing the area immediately adjacent said elastic trim member so that a major portion of said elastic wrap can be easily separated from said elastic trim member.

7. An elastic wrap according to claim 6 wherein said second sheet forms a port cover when said base portion of said plant materials consists of a potted plant.

8. A method for utilizing two types of plant material covers simultaneously, which comprises the steps of:

A. Cutting an opening within a primary plant material cover;

B. Fixedly securing to said opening an expandable, elastic trim member;

C. Covering said opening with a secondary plant material cover;

D. Inserting said plant materials having a base portion and a top portion through said covered opening in said primary plant material cover;

E. Securing said secondary plant material cover to an upward portion of the base portion of said plant materials utilizing said expandable, elastic trim member; and F. Covering the remaining top portion of said plant materials above said base portion of said plant materials with said primary plant material cover.

* * * * *

UNITED STATES PATENT AND TRADEMARK OFFICE

CERTIFICATE OF CORRECTION

PATENT NO. : 5,239,775

DATED : August 31, 1993

INVENTOR(S) : SIMCHA LANDAU

It is certified that error appears in the above-identified patent and that said Letters Patent is hereby corrected as shown below:

At column 6, line 9, change the word "port" to --pot--.

At column 6, line 12, change the word "covers" to --coverings--.

Signed and Sealed this

Nineteenth Day of April, 1994

Bruce Lehman

*Attest:*

BRUCE LEHMAN

*Attesting Officer*

*Commissioner of Patents and Trademarks*